United States Patent [19]

Sun et al.

[11] Patent Number: 4,730,972

[45] Date of Patent: Mar. 15, 1988

[54] BOOK BINDING METHOD, PAPER SHEETS BINDER AND ADJUSTABLE SPINE

[75] Inventors: Rickson Sun; David M. Kelley; Craig F. Sampson; Cynthia L. Benjamin, all of Palo Alto; Dennis J. Boyle, San Mateo, all of Calif.

[73] Assignee: Taurus Holdings, Inc., Mountain View, Calif.

[21] Appl. No.: 840,124

[22] Filed: Mar. 14, 1986

[51] Int. Cl.[4] ..... B42C 1/00; B42B 5/08; B42F 3/04; B42F 13/14

[52] U.S. Cl. ..... 412/7; 412/38; 412/43; 281/21 R; 402/48; 402/52; 402/62

[58] Field of Search ..... 281/21 R, 28, 36; 283/63 R; 402/48, 52, 54, 62; 412/7, 38, 43

[56] References Cited

U.S. PATENT DOCUMENTS

| | | | |
|---|---|---|---|
| 635,409 | 10/1899 | Von Sickle | 402/52 |
| 755,380 | 3/1904 | Montgomery | 402/48 |
| 1,841,989 | 1/1932 | Smith . | |
| 1,845,671 | 2/1932 | Lotter . | |
| 2,381,204 | 8/1945 | Cardoza | 129/12 |
| 3,087,498 | 4/1963 | Vogel | 129/23 |
| 3,347,565 | 10/1967 | Konkel | 281/21 R |
| 3,647,306 | 3/1972 | Chamberlin | 402/48 |
| 3,866,274 | 2/1975 | Malavazos | 24/153 |
| 3,938,587 | 2/1976 | Vlan | 165/76 |
| 3,970,331 | 7/1976 | Giulie | 281/21 R |
| 4,075,924 | 2/1978 | McSherry et al. | 85/3 R |
| 4,175,880 | 11/1979 | Muller | 402/48 |
| 4,287,644 | 9/1981 | Durand | 24/16 PB |
| 4,294,156 | 10/1981 | McSherry et al. | 411/345 |
| 4,309,046 | 1/1982 | Giulie | 281/21 R |
| 4,369,013 | 1/1983 | Abildgaard | 412/38 |
| 4,606,666 | 8/1986 | Patton | 402/62 |

FOREIGN PATENT DOCUMENTS

| | | |
|---|---|---|
| 3204087 | 8/1983 | Fed. Rep. of Germany . |
| 2505262 | 11/1982 | France . |
| 321594 | 11/1929 | United Kingdom . |
| 519400 | 3/1940 | United Kingdom . |
| 950768 | 2/1964 | United Kingdom . |
| 2065555 | 1/1981 | United Kingdom . |

*Primary Examiner*—Howard N. Goldberg
*Assistant Examiner*—Taylor J. Ross
*Attorney, Agent, or Firm*—Thomas S. MacDonald; Alan H. MacPherson; Paul J. Winters

[57] ABSTRACT

A two-part binding system includes one or more bifurcated posts integrally extending from a clamping strip or member. The posts are inserted into one or more apertures in a stack of punched paper or other material and a second clamping strip having one or more integral or separate latching buttons inserted over and around the posts. Each button includes one or a pair of toothed pawls integrally hinged to a cross bar extending across a button aperture. The posts contain a series of transverse ratchets facing each other. As the second strip and its integral or snap-in latching button is manually pressed over the posts toward the first clamping strip, the teeth of the pawl teeth ratchet successively into the posts toward the base of the posts until the stack of paper is firmly grasped and the teeth mesh with a final transverse ratchet. At this position, the strips are bowed putting the edges of the stacked sheets in compression. A spine is also disclosed which has a series of parallel spaces score lines, and is bent around the edges of both clamping strips and firmly adhered to the strips. A simple tool to unlock the pawls is also disclosed. This allows substitute pages to be inserted into the stack and the same clamping strips to be manually reconnected.

50 Claims, 23 Drawing Figures

BOOK BINDING METHOD, PAPER SHEETS BINDER AND ADJUSTABLE SPINE

BACKGROUND OF THE INVENTION

1. Field of the Invention

This invention pertains to a book binding method and binder for retaining and clamping a margin of apertured material such as a stack of hole punched sheets. More particularly, the invention is directed to binding elements to bind a sheaf of papers into a bound report or booklet without the use of any machinery or hand tool. An improved spine cover may also be utilized with the binder elements.

2. Material Information

Various binding systems have been utilized in the past such as the common ring binder, the Acco fastener type, the plastic spiral binder, interlocking through-hole devices, and the plastic headed stud and strips type. The latter two types of binders are exemplified by U.S. Pat. No. 3,970,331 where ratchet teeth are employed on a stud which engage a mating ratchet tooth with a blocking means for permanently holding the matching teeth together; U.S. Pat. No. 4,175,880 where alternate detent containing sleeves extend from binding strips into a stack of writing material; U.S. Pat. No. 4,369,013 where studs integral with a strip are sheared and headed by a machine to clamp a sheaf of papers between two strips; and U.S. Pat. No. 1,841,989 which shows a wedge lock binder for apertured sheets. U.K. Patent No. 950,768 shows a pair of ratcheted rods on a strip with toothed washers forced downwardly on the rods to firmly grasp a stack of sheets. Hinged pawls have been employed in the so-called cable tie art where a one-piece flexible strap with ratchet teeth is utilized to clamp a bundle of wires. U.S. Pat. No. 4,287,644, exemplifies this art.

The prior art in most instances requires the use of special binding machinery or hand tools and in most cases, requires destruction of the binding elements if it is desired to replace a sheet within the bound stack. Further, several of the prior art devices have serrations which tend to tear the edges of the through-holes in the paper stack through which the binding elements pass and are not adaptable to incorporation of spine covers or overall booklet covers.

SUMMARY OF THE INVENTION

A binding method and system is disclosed which employs in its preferred embodiment a pair of clamping members in the form of strips colaterally placed on opposed edges of a wide range of thicknesses of a stack of apertured material, such as a sheaf of three-hole punched paper sheets or other panels. One strip has a series of spaced bifurcated posts having facing ratcheted surfaces. The other strip termed herein a "locking button" has an integral pair of hinged pawls or a single hinge pawl. In assembled pressed-together position, the hinged pawls interlockingly mesh with inner ones of the ratcheted surfaces of the posts to firmly hold the stack. The binding system save for the pair of flat clamping members or edge strips is within the stack of apertured material being bound resulting in a thin completed profile and permitting combination with a flat cover and/or spine around the sheets. The bifurcated post may be circular or rectangular or other shape corresponding to the aperture in the sheets, and is smooth on the outside so as to prevent tearing or abrasion of the apertures in the sheets being assembled. A Belleville-spring like bowing is provided on the strips when assembled, so as to firmly and positively clamp an edge or margin portion of apertured sheets and prevent loosening of the stack or inadvertent pull-out of one or more of the assembled sheets.

No tool or machine is required to assemble the binding system, user hand and finger pressure alone being sufficient to form the binding with no-time-consuming rotation of parts. The system may be installed from either the top or bottom of a horizontal stack of paper sheets or other apertured material. The elements of the two separate clamping members and the clamping members used with strips may be integrally molded obviating the necessity of any supplemental hardware. Preferably, the complete binding system is of plastic material resulting in a light-weight, easily shipped and packaged, and attractive construction in a variety of colors. The construction allows one size of binder members or strips to be usable over a wide range of thicknesses of the apertured materials from a few sheets to as many as several hundred sheets in an assembled thickness of five or six or more centimeters.

In normal usage, a permanent connection or binding results which cannot be accidentally opened. The construction does allow the user, by design, to manually or with a simple tweezer-like tool nondestructively unlock the binder and to relieve the bowing pressure. This permits removal and/or addition of sheets from and to the stack and reinsertion of the same binding elements to rebind the stack.

A particular application of the instant binder system is to replace a ring binder when the contents of that binder have been completed and it is contemplated that no additions or deletions will be made. All the necessary apertures of the sheaf of papers, normally three-hole punched papers, are present so that the binding elements can easily be clamped on a vertical edge of the stack linearly with the row of holes and assembled. The ring binder which has an acquisition cost of several times that of the binding system of this invention is available for reuse and its former contents is semi-permanently bound in a thinner, less-expensive volume which takes up less shelf space or can be more easily stacked with other volumes than the ring binder itself.

An additional feature of the invention is a universal spine or spine and cover combination which may be assembled around the clamping members to cover the spine of the assembled sheaf of papers, booklet or report to present a more finished and professional binding appearance. The universal spine is adjustable so as to accommodate various stack thicknesses.

The present invention is of general utility and may be used by the millions of owners of three-hole paper punches and the millions of buyers of prepunched three-hole and other paper throughout the world with the most simple instruction—Insert—Press—Break-off.

DETAILED DESCRIPTION

Figure 1:
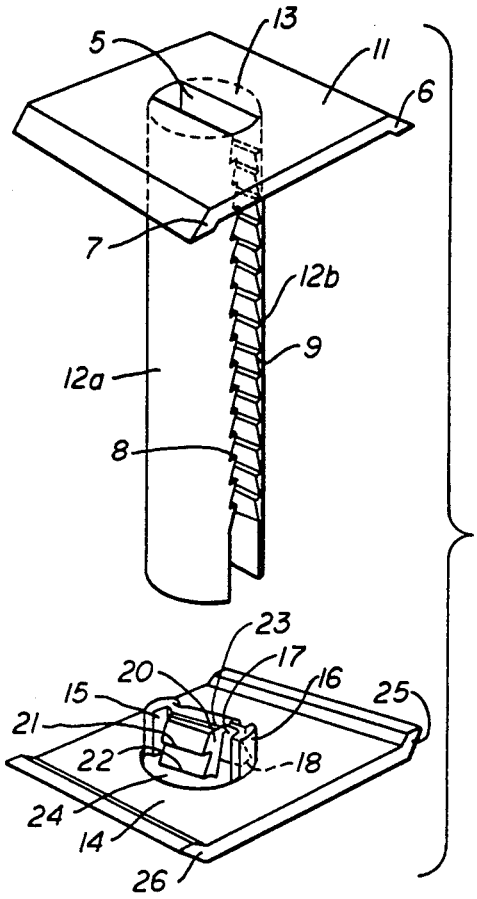
FIG. 1 is a perspective view of the two-part binder clamping system.

FIG. 1 illustrates a two-part binder 10 which includes a first clamping member 11 having integrally extending from a generally flat head of about 1.3 cm square or other peripheral configuration, and a bifurcated post forming a pair of posts or legs 12*a* and 12*b* essentially D-shaped in cross section. The pair of spaced split posts 12*a* and 12*b* have a linearly extending transversely ratcheted surfaces 8 and 9 facing each other. The posts or legs may typically be about 0.17 cm in maximum thickness and 7–8 cm in length, thus accommodating a wide range of thicknesses of stacked material, namely, from that of a few sheets 0.05 cm to about 5 cm for many sheets. The ratchets have a height of about 0.03 cm and a slope angle of about 59°. The bifurcated post has a diameter about 0.6 cm and a 0.3 cm wide slot between the legs. The posts are made of a notch-sensitive plastic material.

A second clamping member 14 generally matched in exterior configuration to member 11 is positioned parallel to and spaced from the clamping member 11 on opposed sides of a sheaf of apertured material such as three-hole punched paper. Clamping member 14 may be made of molded nylon or other plastic material. A pawl member is integrally attached to member 14 which together form a double latch button. Pawls 18 and 20 extend across an essentially circular aperture 24 in member 14 forming a pair of oppositely facing essentially D-shaped channels (FIG. 5) extending between the sidewalls of the aperture and the mounted pawl member. The pawl member is mounted by a pair of diametrically opposed posts 15 and 16, also called herein upstanding linear members, extending integrally from member 14 towards the first clamping member 11. An integral crossbar 17 extends across the top of posts 15 and 16 and integrally mounts the pair of linearly extending pawls hinged by hinge means 23 to crossbar 17. Pawl 18 shown in dotted lines extends parallel to pawl 20 and likewise is integrally hinged to crossbar 17. Each of clamp members 11 and 14 have edge extensions 6, 7, and 25, 26 respectively, which aid in transmitting a clamping force to the sheaf of papers to be clamped by the clamping members. Each of the pawls 18 and 20 have two or more clamping teeth 21 and 22 extending parallel to each other and transversely of the pawls. Teeth 21 and 22, upon insertion of the post 12*a* and 12*b* into aperture 24 and the formed essentially D-shaped channels, mesh succeedingly with each of the facing transverse ratchets 8 and 9 as the clamping members are slidingly assembled on a sheaf of apertured material. Clamping member 11 may contain a top aperture 5 to receive part of the crossbar 17 when only a few sheets of apertured material are being bound. In some applications where a considerable number of sheets are to be bound, the top of element 11 may be unperforated.

Figure 2A:
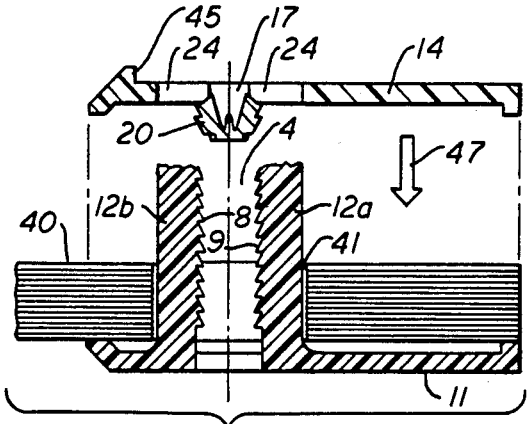
FIG. 2A is a partial cross-sectional view of the clamping elements including a double latch button in a first step in their assembly.
Figure 2B:
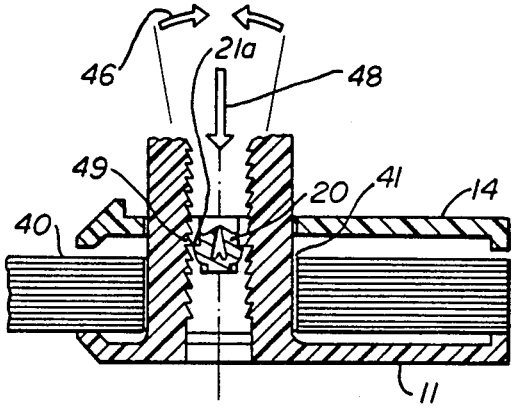
FIG. 2B is a partial cross-sectional view of the clamping elements in a second step in their assembly.
Figure 2C:
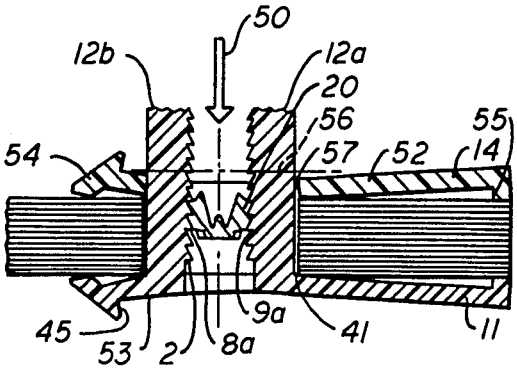
FIG. 2C is a partial cross-sectional view of the clamping elements in a third step of their assembly showing a full clamping force on an assembled sheaf of apertured paper sheets.

FIG. 2A shows the assembly operation wherein the posts of clamping member 11 are placed within an aperture or punched hole 41 of apertured sheets 40. The latch button clamping member 14 is then mounted (arrow 47) and pressed (arrow 48, FIG. 2B) downwardly over the post 12*a* and 12*b* with the pawl member 20 being ratcheted downwardly through a slot 4 between posts 12*a* and 12*b* so that the teeth 21 and 22 of pawls 20 and 18 mesh and unmesh with each of the transverse ratchets on ratcheted surfaces 8 and 9. This action is shown clearly in FIG. 2B where the arrows 46 indicate the inward movement of the pawls 20 and 18 as they pass an inwardly directed top ridge 49 of the ratchets 8 and 9. The user continues to push member 14 downwardly towards member 11 as shown by arrow 50 (FIG. 2C) until an innermost transverse ratchet 8*a* and 9*a* on the legs on which the user can effectively apply pressure is reached. The ratchet notches may be undercut with a reentrant surface 2 so that any outward force on the clamping members puts additional locking force on the pawl teeth and its associated transverse ratchet. The sheaf of papers 40 are then firmly clamped at points 55 and 54 on both sides of the sheaf of papers and each of the flat sections of clamp members 11 and 14 bow as indicated at 52 and 53. The edge portions of the paper stack on either side of the aperture 41 are then under a Belleville-spring bowed compression and are firmly grasped by the clamping members.

Member 14 is constructed of a notch sensitive plastic such as ABS, i.e. acrylonitrile butadiene styrene, of sufficient brittleness, e.g. about 200 joules/meter, so that upon bending each of the legs 12*a* and 12*b* outwardly against the edge 57 of aperture 24 in member 14, the frangible legs 12*a* and 12*b* break off essentially across a plane 56 then the edge 57 at the thin root of one of the transverse ratchets on the legs leaving a clean break generally flush with the top surface of member 14. The root of each ratchet has sufficient stress concentration so that it can be easily snapped off at the aperture edges. The posts pass freely through the channels but are sufficiently close, e.g. about 0.008 cm. to the edges of the channels so that the post may be pivoted around the edges to break-off the excess post material. In one embodiment of the invention, this completes the binding assembly operation.

Figure 3:
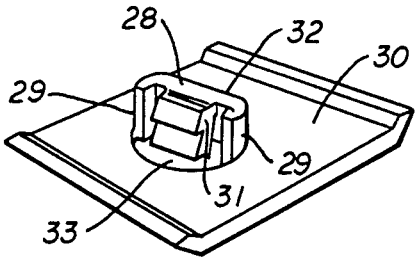
FIG. 3 is a perspective view of an alternative embodiment of a single latch button.

FIG. 3 shows a second embodiment of the second clamping member in which a single pawl 31, i.e. a single latch button, is extended across aperture 33. The single pawl 31 is on one side only of a bar 28 bisecting a pair of integral upstanding posts 29 extending from the inner surface of clamping member 30. Opposite the pawl member 31 is a flat surface 32 on the cross bar. As in the double latch button embodiment of FIGS. 1 and 2, a pair of oppositely facing essentially D-shaped channels are formed by the bar and the side walls of aperture 33.

Figure 4A:
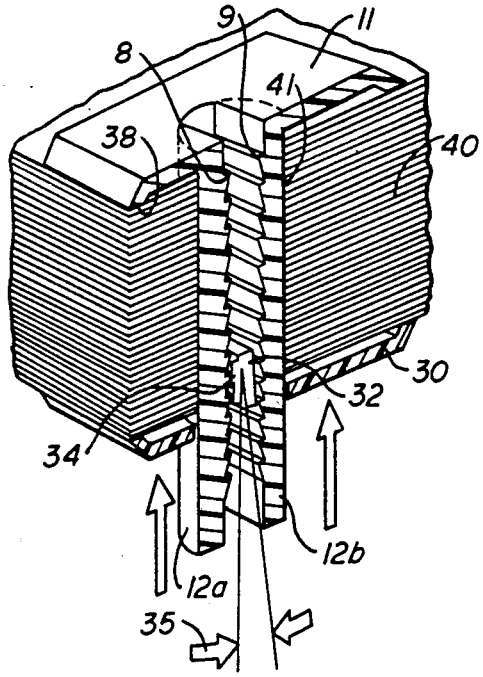
FIG. 4A is a cross-sectional view of a single latch button and split post showing a first assembly step on a sheaf of papers.
Figure 4B:
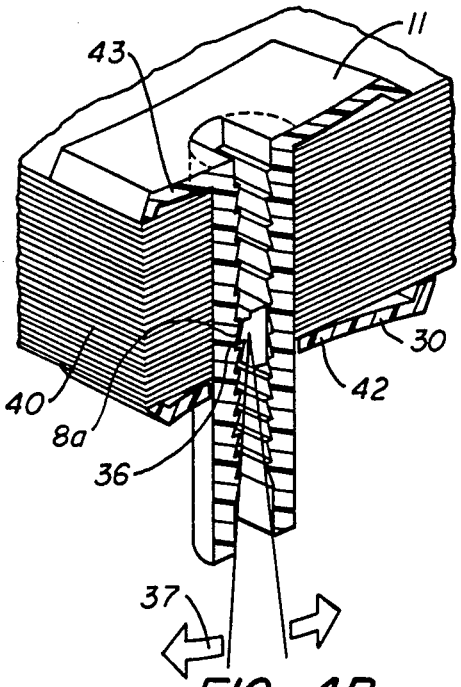
FIG. 4B is a cross-sectional view of assembled clamping members utilizing a single latch button.

Operation of the single latch button of FIG. 3 is seen in FIGS. 4A and 4B. The integrally attached posts 12*a* and 12*b* of member 11 are inserted into the apertures or holes 41 of a sheaf of paper sheets 40 and into clamping member 30. The smooth backside 32 of bar 28 slides uninterrupted along one set of transverse ratchets 9 while the teeth of pawl 31 mesh with each succeeding transversed ratchet 8. Manual pressure is applied by pushing on the edges of clamping member 30 while member 11 lies on a flat, nondeflecting surface such as a table or desk to a point where the flat portions of members 11 and 30 are bowed as to 42 and 43 and the teeth on the pawl are firmly meshed with the innermost transverse ratchet 8*a* on one of the facing sides of posts 12*a* and 12*b*. Arrows 35 in FIG. 4A show the single pawl in the inward position where it is sliding past a ridge of the ratcheted surface and in FIG. 4B, arrows 37 show the pawl teeth meshed into the root of transverse ratchet 8*a*. If desired a ratchet surface may be employed on only one of the facing bifurcated posts. In such embodiment care must be taken to orient the member 11 so that the single pawl of the pawl member of the FIGS. 4A, 4B embodiment is positioned facing the single ratcheted surface. It is to be understood that the excess post material is then broken off as more particularly shown in FIG. 10C leaving the ends of the bifurcated post generally flush with the outer surface of button latch member 30.

Figure 5:
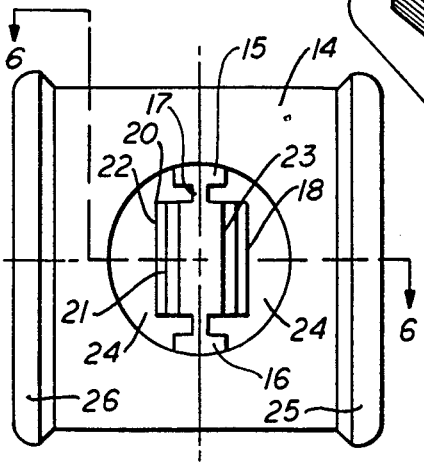
FIG. 5 is a top plan view of the double latch button clamping member shown in FIG. 1.

FIG. 5 is a plan view of the double latch pawl member 18 and 20 extending diametrically across aperture 24 parallel to ridge sections 25 and 26. The pawls are hinged by integral hinges 23 to bar 17 which extends from post 15 and 16 from the inner surface of clamp member 14.

Figure 6:
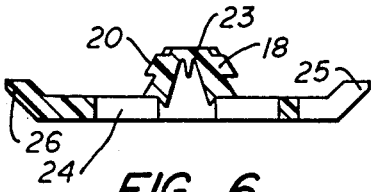
FIG. 6 is a cross-sectional view of the double latch button taken on line 6—6 of FIG. 5.

FIG. 6 shows a detailed cross-sectional view of the double latch member 14 and integral pawls 18 and 20.

Figure 7:
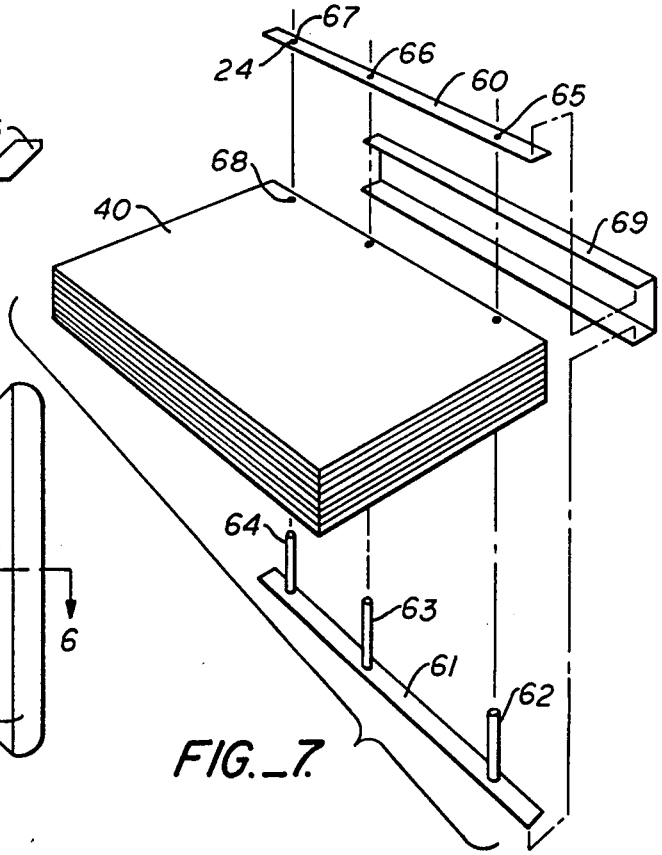
FIG. 7 is an exploded perspective view of the overall binding system with auxiliary spine.

FIG. 7 illustrates a sheaf of three-hole punched paper. A strip 61 containing a set of three integral upstanding bifurcated posts 62, 63 and 64 is inserted into apertures 68. The strip 60 is then placed over the posts 62, 63 and 64 so that a set of latch buttons 65, 66 and 67 and pawls therein are aligned therewith. The bifurcated posts pass through the apertures 24 on either side of the pair of pawl members. Once excess post material which extends exterior of strip 60 when clamped and assembled is broken off, then a spine 69 may be inserted over the edge of the spine of paper stack. For certain applications where a series of fixed sizes of stacked papers is to be utilized, a corresponding series of spines 69 having an inner width corresponding to the width between the exterior surfaces of strip 60 and 61 is provided for covering the strips and the spine of the sheaf of papers. The spine cover may be affixed by adhesive or have sufficient flexibility to be clamped over the clamping members and booklet spine.

Figure 8:
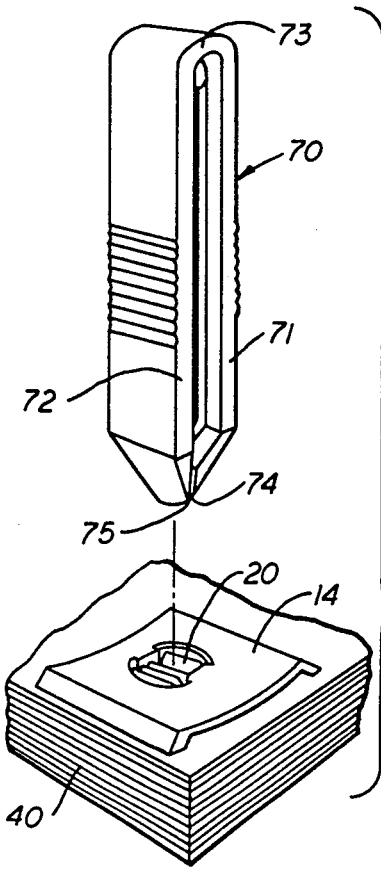
FIG. 8 is a perspective view of a tweezer tool and double latch button clamping member for releasing the clamping force.

As had been described, the above binding is considered to be permanent and cannot accidentally be undone. However, FIG. 8 does show a simple tool for releasing clamp member 14 from its assembly with clamp member 11. A tweezer-like tool 70 having a pair of bifurcated arms 71 and 72 is joined by an integral U-shaped portion 73 and has at its open end, a pair of grasping fingers 74 and 75.

Figure 9:
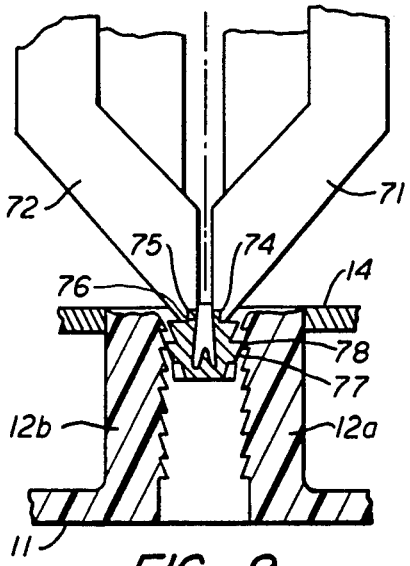
FIG. 9 is a partial cut-away cross-sectional view of the assembled binder system showing the releasing action of the tool of FIG. 8.

FIG. 9 indicates the action of grasping fingers 74 and 75 which are placed manually in abutment with a linear boss 76 extending laterally across the top of each pawl member. By squeezing arms 71 and 72 together, finger ends 74 and 75 grasp the boss and move the teeth 77 of the pawls out of engagement with the transverse ratchets 78 and 79 of post 12*a* and 12*b*. This permits removal of the post and the latch button from the assembly and allows a few papers to be added to the stack or substitute pages placed in the stack. It is realized that since the posts 12*a* and 12*b* have already been broken off, that there is not too much latitude to add much thickness of paper and still have a secure re-engagement of the pawl teeth with the transverse ratchets of the arms 12*a* and 12*b*. In the event that multiple bifurcated posts and lock buttons are employed along the strips, a ganged tweezer device which would simultaneously squeeze each pair of pawls inwardly would allow for separation of one strip from the other. Alternatively, each lock button could be released a few notches in seriatim until the whole assembly comes apart.

Figure 10A:
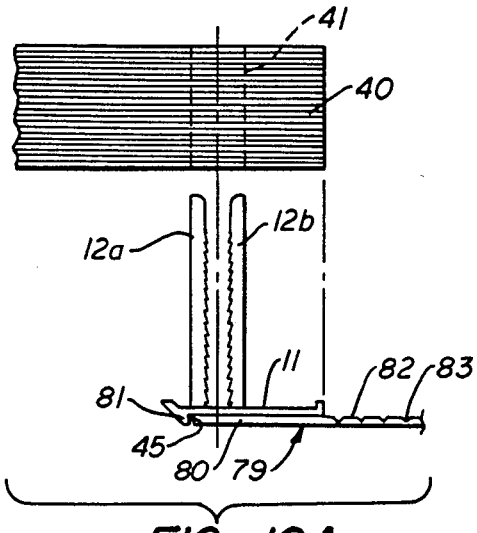
FIG. 10A is a partial side view of a post-containing clamping member with attached spine cover.
Figure 10B:
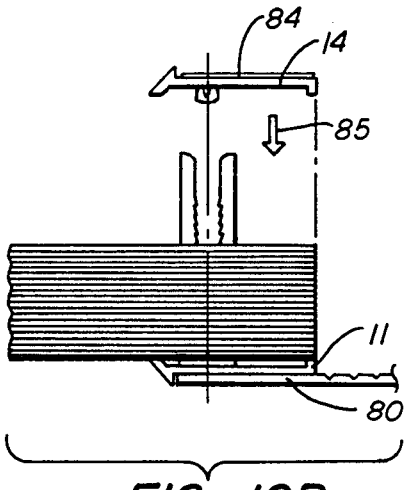
FIG. 10B is a partial side view showing the first step in assembly of the first and second clamp members.
Figure 10C:
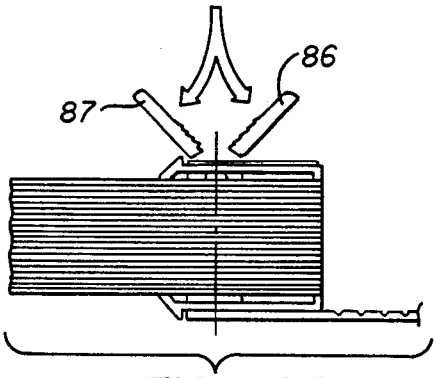
FIG. 10C is a partial side view illustrating a completed second step and the third step of binder assembly, namely, breaking unneeded post extensions.
Figure 10D:
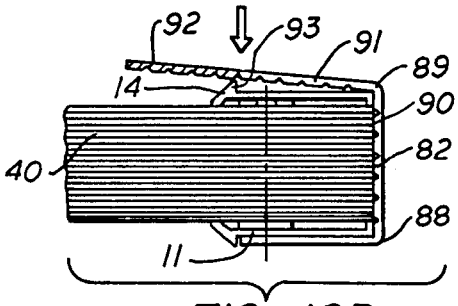
FIG. 10D is a partial side viewing showing the subsequent step of bending the spine cover around the spine of the assembled sheets.
Figure 10E:
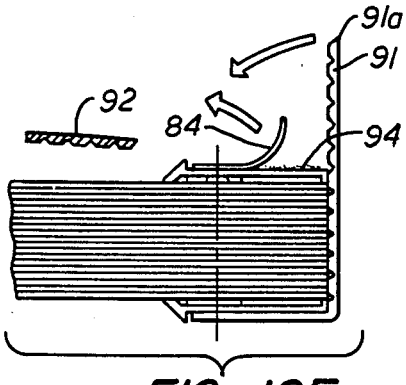
FIG. 10E is a partial side view of the spine showing the next step of tearing or breaking off excess spine material and preparing the latch button clamping member for receipt of the spine.
Figure 10F:
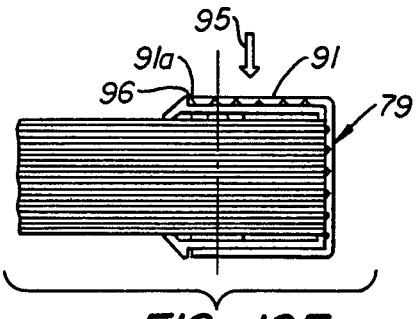
FIG. 10F is a partial side view of a spine fully assembled on the two-part clamping members.

FIGS. 10A through 10F illustrate a series of steps for the mounting of a preferred form of a book spine around the clamping members 11 and 14. A book spine 79 has a variable width and a boundary edge 80 mounted to the exterior surface of clamping member 11 abutting a ridge 81 of member 11 at perpendicular surface 45. Spine 79 contains a series of closely spaced parallel bending score lines extending along the length and a desired width of the spine. Score lines 83 extend over book spine portion 82 and portions 90, 91 and 92 (FIG. 10D). Each of the score lines are approximately 0.038 cm deep and are spaced approximately 0.25 cm between centers. The overall thickness of the spine material is typically about 0.076 cm and made of a plastic material such as flexible PVC (polyvinyl chloride) plastic. After the posts 12*a* and 12*b* in an elongated strip clamping member 11 have been inserted into the three apertures 41 say in a three-hole paper stack 40, the latch buttons 14 are placed over each set of posts 12*a* and 12*b* as seen in FIG. 10B and pushed downwardly to firmly clamp the members 11 and 14 together as in FIG. 2C. The end 80 of the spine 79 is firmly attached to the exterior of clamping member 11 by suitable adhesive, or integrally molded or extruded. In FIG. 10C the clamping members have been firmly brought together, the interior teeth of the pawls have locked with the innermost ratchet surfaces of the posts dependent on the thickness of the stack and the pressure exerted. The unneeded ends 86 and 87 of the posts are broken off at the top of the latching buttons and removed.

As seen in FIG. 10D, the remaining up-to-then flat portion of the spine 79, more particularly portion 82, is folded at corner score line 88 so that inner surface of spine portion 82 is flush with the spine 90 of the stack of paper sheets 40. The remainder 91 and 92 of the spine is folded at score line 89 or other score line dependent on the clamped thickness of the stack and placed against ridge 93 on member 14. That portion 92 of the spine that overhangs the ridge is torn or broken off, FIG. 10E, by use of ridge 93 or a straight edge rule or the like, and discarded. A protective strip 84 is removed from the top surface of the clamp plate 14 leaving an adhesive surface 94 exposed. The remaining second boundary edge 91 on the spine is then bent downwardly and a force applied by manual pressure indicated by arrow 95 on edge portion 91 against the adhesive 94 on member 14 so that portion 91 is adhered thereto. The outer edge 91*a* of the spine abuts or is slightly spaced to the vertical edge 96 of the ridge 93 on member 14. The spine lateral boundary edges are thus captured and protected so that they cannot peel away easily from the clamping members. The resultant spine is firmly affixed to both clamping members and covers the spine 90 of the stack of sheets.

Figure 11:
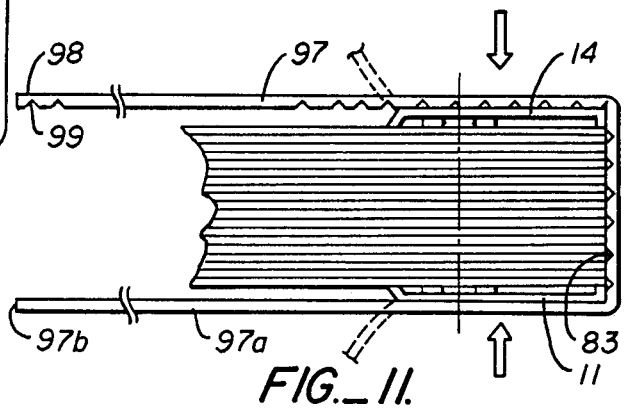
FIG. 11 is a partial side view of a spine covering including an integral overall cover for a clamped sheaf of apertured material.

FIG. 11 is a further modification of the book spine in which the book spine also includes full cover portions 97, 97*a* extending to outer edges of the overall cover. In this embodiment, the latching button 14 and the clamping member 11 do not include ridges 93. The cover has a multitude of spaced scored lines 83 at its center and on one cover end 98 which are bent successively around each of the corners of the clamped stack of apertured papers or dependent on the thickness of the stack. The portions of the cover abutting clamping members 11 and 14 are adhered thereto by suitable adhesive. Any excess material on the outer edges of the cover end 98 may be broken off at score lines 99 or sheared by a shearing bar of a paper cutter or by scissors. Cover 97*a* generally will be the front cover since its outer edge 97*b* will be first placed into position with respect to the unclamped margin of the paper stack. The dashed lines show covers 97, 97*a* in open position.

Figure 12:
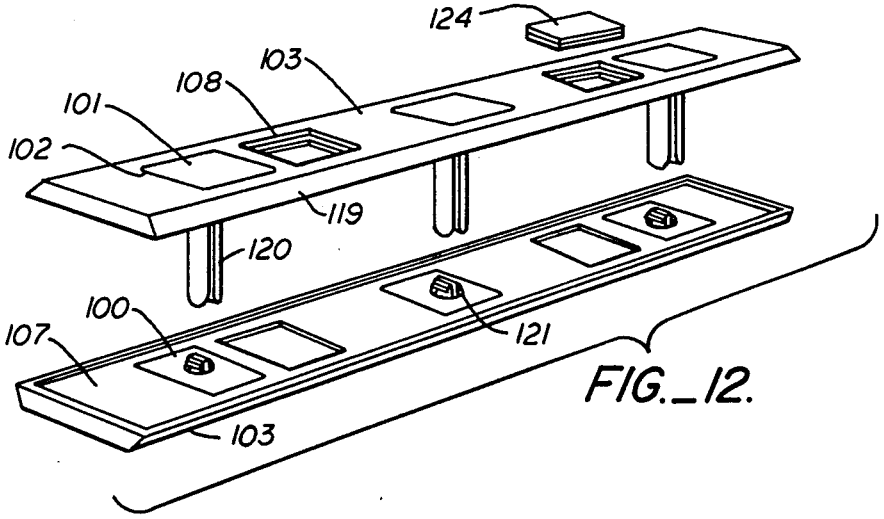
FIG. 12 is an exploded perspective view of another embodiment of the binder.

A further embodiment of the invention is seen in FIG. 12 where snap-in buttons, snap-in posts, and strips are shipped loose. A user inserts flat-headed buttons 100 and flat-headed T-posts 101 in the appropriate holes 102 in the strips 103, dependent on the sheaf of papers being two-hole or three-hole punched. Snap ridges 104 on the clamping member heads and ridges 105 in the strip apertures 102 give user feedback during assembly and keeps the buttons and posts from falling out while binding. When bound, flanges 119 on the strip edges bow and aid in keep the buttons and posts from pulling through the strips. The recesses 107 in the strips provide room for the bowing action. Flat-headed dummy members 124 with peripheral side edges may be provided to snap into the empty apertures 108, i.e. the unused ones of the series of intermediate apertures 102 in both strips 103. If desired, particularly in the case of dissimilar materials of construction, the flat-headed members may be factory-assembled in the strips by swaging or other forms of affixation.

Figure 13:
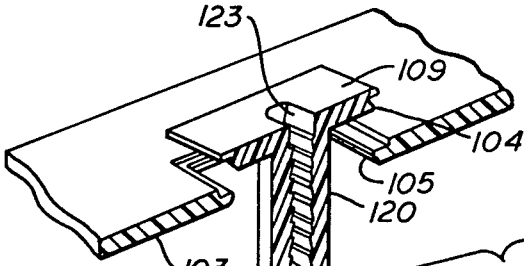
FIG. 13 is a cutaway cross-sectional perspective view of a modified snap-in T-post clamping member with a binding strip.

FIG. 13 is a broken-away cross-sectional perspective view showing the snap-action slightly flexible ridges 105 on the strip and the ridges 104 on the periphery T-post top 109. An interference fit may also be employed. As in the other embodiments the serrated bifurcated posts 120 are locked when assembled with a pawl member 121 of a button 100.

Figure 14:
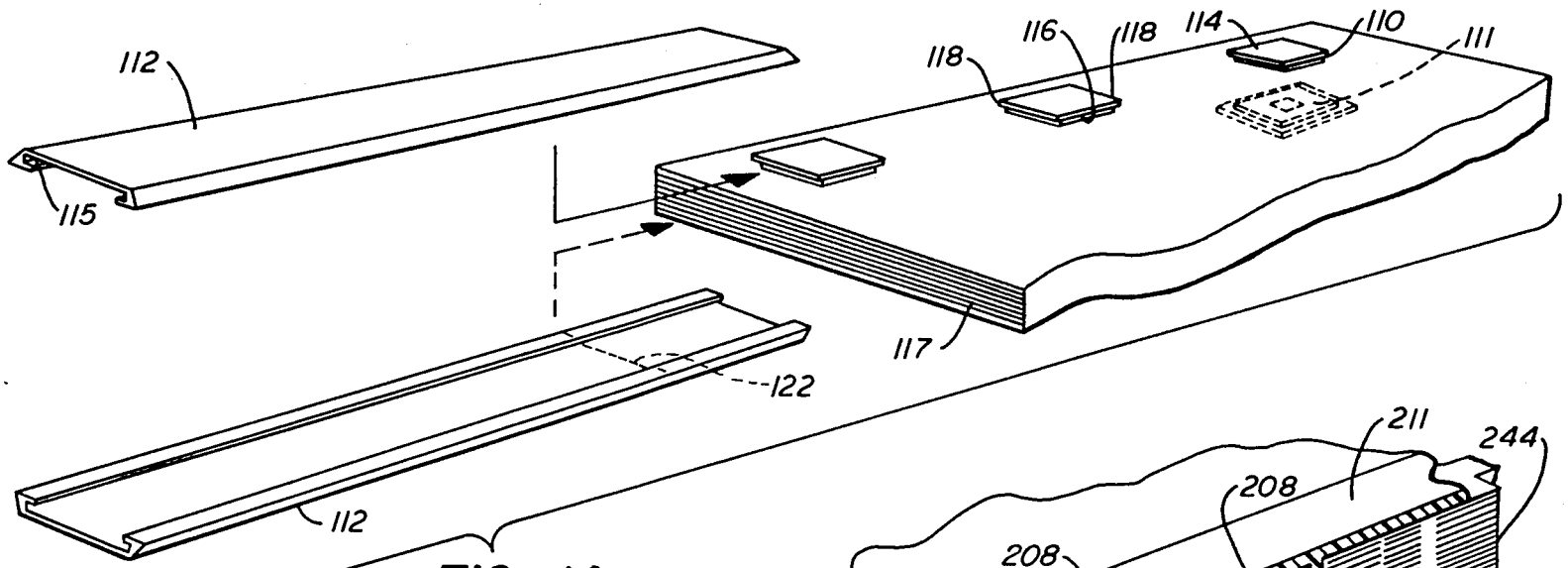
FIG. 14 is an exploded perspective partial view of a further embodiment of a clamped document and carrier strips therefor.

An additional embodiment of the invention is seen in FIG. 14. Again, buttons, posts and strips are shipped loose. A user binds a document with individual posts 110 and buttons 111, and then slides carrier strip 112 onto the protruding heads 114. The strip can be cut by the user to shorter lengths at the marks 122 indicated for special applications or the strip may be furnished to user with score marks to allow various lengths to be broken off for use with a sheaf of letter or legal size paper, for example. A groove 115 in the carrier strip 112 slides laterally on lateral side lips 118 forming a reentrant groove 116 on the series of headed clamping members extending in a plane above the plane of the bound document when the T-posts 110 and T-buttons 111 are assembled on the document. In FIG. 14 the document 117 is shown already bound and positioned to receive the finishing carrier strips 112 on their top and bottom sides. Aperture 123 in head 109 allows the pawl(s) of the second clamping member to extend therein when only a few sheets of apertured material are being clamped.

Figure 15:
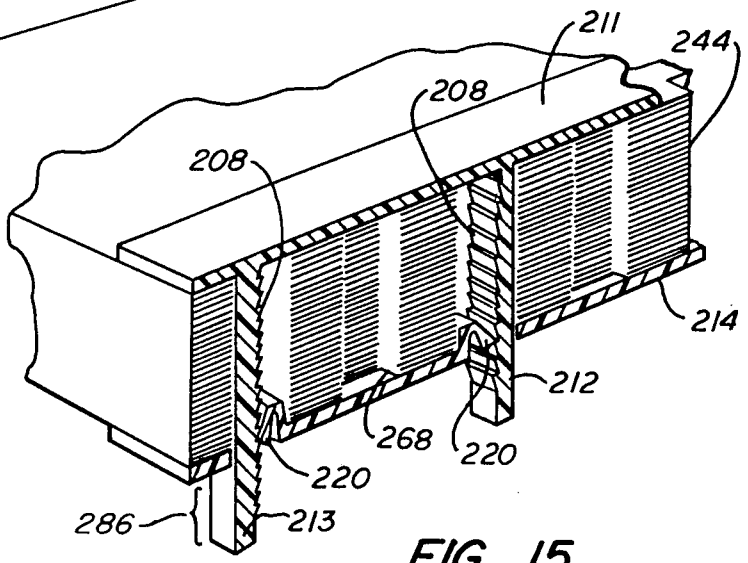
FIG. 15 is a perspective cross-sectional partial view of another embodiment taken along a marginal plane including a series of rectangular apertures in a paper stack.

FIG. 15 illustrates a further application of the invention in which posts 212, 213 integrally extending from clamping strip 211 are rectangular in cross section and are passed through rectangular apertures 268 in punched paper sheets 244. Apertures 268 are inboard of a side or top marginal edge (not shown) of the paper sheet stack. As shown, the post 212, 213 may be spaced so as to skip one or more of apertures 268 so that they pass through nonadjacent apertures. As in the prior embodiments, serrated surfaces forming transverse ratchets 208 are provided on facing sides of posts 212, 213. A second clamping strip 214, having integrally hinged pawls 220 spaced correspondingly to the posts, is placed over the ends of posts 212, 213 which protrude from the stack of sheets 244. The strip 214 is then pressed inwardly with respect to strip 211 ratcheting the pawls 220 on ratchets 208 to a retaining position within the then bound stack. The protruding ends 286 of the posts are then broken off completing the assembly.

The above decription of embodiments of this invention is intended to be illustrative and not limiting. Other embodiments of this invention will be obvious to those skilled in the art in view of the above disclosure.

We claim:

1. A method of binding a book having plurality of sheets formed with a plurality of spaced apertures adjacent a margin of said book comprising:

inserting a first clamping member, having a pair of spaced posts with ratcheted surfaces extending across said posts and facing each other, into and through at least one of spaced apertures;

placing a second clamping member, having a hinged pawl means extending across said second clamping member, over said pair of posts such that said pawl means meshes with at least one of said ratcheted surfaces;

pressing said first and second clamping members together with a force until said pawl means is pushed into said spaced apertures of said plurality of sheets and is forced into the most inward of at least one of said ratcheted surfaces dependent on the thickness of said plurality of sheets and the amount of said force; and then breaking-off at a ratcheted surface any excess of length of said posts which extends beyond said second clamping member outboard of said pawl means.

2. The method of claim 1 further comprising:

mounting a spine cover over said first and second clamping members; and attaching said spine cover to said first and second clamping members.

3. The method of claim 1 further comprising:

providing a series of first clamping members corresponding to the plurality of spaced apertures in said sheets on a first strip;

providing a series of second clamping members corresponding to the plurality of spaced apertures in said sheets on a second clamping strip;

aligning said strips with respect to said margin; and simultaneously pressing said clamping members and strips together to bind said book.

4. The method of claim 3 further comprising:

inserting discrete ones of said first and second clamping members into matching ones of a series of apertures in said first and second clamping member strips; and pressing said first and second clamping members and said strips together to bind said plurality of sheets.

5. A binder comprising:

a first clamping member;

a pair of spaced posts extending integrally from said first clamping member, said posts having at least one linearly-extending traversely ratcheted surface facing the other of said posts;

a second clamping member parallel to and spaced from said first clamping member to clamp a stack of apertured material therebetween;

a pawl member attached to said second clamping member and extending toward said first clamping member;

a first aperture extending through said second clamping member adjacent said pawl member; and means extending across said first aperture for hingedly mounting said pawl member and separating said first aperture into two channels such that, upon assembly of said clamping members on said apertured material, said posts extend through a margin aperture in said apertured material, respective ones of said spaced posts pass through respective ones of said channels, and said pawl member meshes with successive transverse ratchets of at least one of said ratcheted surfaces to firmly clamp said stack of apertured material together.

6. The binder of claim 5 wherein at least one of said first and second clamping members includes means for storing spring energy wherein said clamping members have sufficient flexibility so as to be bowed when said posts are cinched together by meshing of said pawl member with successively transverse ratchets of said ratcheted surface, such that said apertured material is spring-bowed tensioned.

7. The binder of claim 5 in which said pawl member comprise a pair of linearly-extending pawls extending from said means for hingedly mounting wherein, upon assembly of said clamping members, each of said pawls mesh with a facing one of a ratcheted facing surface of one of said posts.

8. The binder of claim 5 wherein said first aperture and said margin aperture are essentially circular, said channels are essentially D-shaped in cross section and said posts are essentially D-shaped in cross section, such that said posts slide through said channels and margin aperture in said apertured material.

9. The binder of claim 5 in which said means for hingedly mounting of said pawl member comprises:

a pair of upstanding linear members integral with and extending from diametrically opposite positions on said second clamping member at a periphery of said first aperture;

an integral crossbar extending between said upstanding linear members; and hinge means integrally attached to said crossbar and said pawl member.

10. The binder of claim 5 in which said spaced posts, upon assembly through said margin aperture and said channels, extend exteriorly of said second clamping member in a direction away from said first clamping member and wherein a wall of each said post adjacent a root of said ratcheted surface is sufficiently frangible to be broken away in a plane essential corresponding to a plane of an exterior surface of said second clamping member.

11. The binder of claim 5 wherein each of said first and second clamping members include an inwardly-facing ridge on opposed side edges, said clamping members having sufficient flexibility so as to be inwardly bowed when said posts are cinched together by meshing of said pawl member with successively inward transverse ratchets of said ratcheted surface, such that said apertured material is spring-bowed tensioned.

12. The binder of claim 5 wherein said first and second clamping members are elongated plastic strips having a length substantial the same as the height of said apertured material and wherein a series of sets of spaced posts and pawl members are linearly spaced, respectively, along said strips at positions corresponding to positions of a series of margin apertures in said apertured material.

13. The binder of claim 12 including three sets of spaced posts and three pawl members, respectively, on each of said first and second clamping members and in which said apertured material is a stack of three-hole punched paper sheets.

14. The binder of claim 5 wherein, upon assembly of said clamping members, said pawl member meshes with a most inward position of said transverse ratchets as permitted by the thickness of said stack of said apertured material such that said most inward position is within the stack of said apertured material.

15. The binder of claim 5 in which said posts are constructed of a hard sufficiently brittle plastic and wherein a stress concentration is present at the root of each transverse ratchet such that said posts may be snapped off along various positions on their lengths dependent on the thickness of the stack of said apertured material being clamped.

16. The binder of claim 5 in which said pawl member includes a notch adapted to be contacted after said first and second clamping members have been assembled on said apertured material by an auxiliary tool for moving said pawl member inwardly away from and released from meshing with said transverse ratchets to remove said second clamping member from said first clamping member.

17. The binder of claim 5 further comprising an undercut reentrant notch on each of said transverse ratchets such that any outward force on said first and second clamping members puts additional locking force on said pawl member and its associated transverse ratchet.

18. The binder of claim 5 in which said spaced posts have an effective peripheral dimension and shape, such that said spaced posts pass freely through said channels but are sufficiently close to edges of said channels such that the posts may be pivoted around said edges to break-off excess length of posts extending from said second clamping member.

19. The binder of claim 5 further comprising:

a book spine;

means for attaching a first boundary edge of said spine to one of clamping members;

a series of closely spaced parallel bending score lines extending along a length and width of said spine;

means including one of said score lines for bending a central portion of said spine around and covering an exposed edge of said clamped apertured material; and means including another of said score lines selected dependent on the thickness of said apertured material, for bending a second boundary edge of said spine into contact with the other of said clamping members after any excess length of said posts has been removed from said clamping members.

20. The binder of claim 19 further including means including another one of said score lines selected dependent on the width of said other of said clamping members for tearing off remaining boundary edge material extending beyond said other of said clamping members.

21. The binder of claim 19 further including a binder cover including an integral spine;

said spine including a series of closely spaced parallel binding score lines extending along a length and a width of said cover dependent on a range of desired spine thicknesses;

means including said score lines to bend said cover about a prescribed range of spine thicknesses; and means to fixedly attach boundary edges of said spine to opposed exterior surfaces of said clamping members.

22. The binder of claim 19 in which said first and second clamping members, include integral longitudinal edge ridges extending outwardly from exterior surfaces of said clamping members; and in which said boundary edges of said spine, when assembled on said exposed edges of said apertured material and said exterior surfaces, are juxtaposed to said edge ridges such that peripheral edges of said boundary edges are protected from peeling off said exterior surfaces.

23. The binder of claim 5 further including a pair of elongated strips having a length substantially the same as the height of said apertured material, said strips having a series of apertures intermediate the ends of said strips; and wherein said first and second clamping member each includes a flat headed portion, said flat headed portions having a peripheral ridge adapted to snap into ones of said series of apertures and be held therein.

24. The binder of claim 23 in which said series of apertures are spaced on said strips to be indexed to standard two-hole and standard three-hole punched paper, whereby said strips and said first and second clamping members may be alternatively used for two or three-hole punched paper.

25. The binder of claim 24 further comprising a dummy flat-headed member having a peripheral ridge adapted to snap-in to unused ones of said series of apertures when said clamping members are assembled in said strips and said punched paper.

26. The binder of claim 5 wherein said first and second clamping members include a flat-headed portion and a reentrant groove extending between said flat-headed portion and said integral posts and said pawl member, respectively;

said binder further including a pair of elongated strips having internally grooved longitudinal edge portions; and wherein said reentrant grooves extend outwardly from a plane of assembled apertured material and said grooved longitudinal edge portions of said strips slide in said reentrant grooves to cover said first and second clamping members.

27. A binder system for a stack of edge apertured material comprising:

a first elongated clamping member extending along a stack edge and having a series of split posts, each of said split posts containing internal facing ratcheted surfaces;

a second elongated clamping member extending along a stack edge on an opposite side of said stack and having at least one pawl member;

means including said series of split posts extending between said members for fixedly clamping a range of thickness of said apertured material between said first and second clamping members by interaction of said at least one pawl member with said ratcheted surface; and further comprising:

a book spine;

means for attaching a first boundary edge of said spine to one of clamping members;

a series of closely spaced parallel bending score lines extending along a length and width of said spine;

means including one of said score lines for bending a central portion of said spine around and covering an exposed edge of said clamped apertured material; and means including another of said score lines selected dependent on the thickness of said apertured material, for bending a second boundary edge of said spine into contact with the other of said clamping members after any excess length of said posts has been removed from said clamping members.

28. The binder system of claim 27 further including means including another one of said score lines selected dependent on the width of said other of said clamping members for tearing off remaining boundary edge material extending beyond said other of said clamping members.

29. A paper stack binder for hole punched sheets of paper comprising:

a first elongated paper clamping member;

a series of split posts integrally extending from one side of said first clamping member for passing through aligned holes punched in said sheets of paper, each split post extending through one of said aligned holes, said posts having a series of trans verse ratchets on facing surfaces of each split post; and a second elongated paper clamping member aligned with said first paper clamping member on an opposite side of a stack of said sheets of paper than said first paper clamping means, said second paper clamping member including a first aperture and a hinged pawl member within said aperture and having at least one pawl hingedly meshing within one of said series of transverse ratchets when said first and second paper clamping members are pushed together on a range of thickness of said stack of said sheets of paper, said series of split posts traversing through said first aperture in said second paper clamping member.

30. The paper stack binder of claim 29 in which said split posts, upon assembly through said sheets of paper and said first aperture, extend exteriorly of said second clamping member in a direction away from said first clamping member and wherein a wall of each said post adjacent a root of said transverse ratchets is sufficiently frangible to be broken away in a plane essential corresponding to a plane of an exterior surface of said second clamping member, such that stacks of sheets of paper of various thickness may be clamped.

31. A paper stack binder for hole punched sheets of paper comprising:

a first elongated paper clamping member;

a series of split posts integrally extending from one side of said first clamping member for passing through aligned holes punched in said sheets of paper, each split post extending through one of said aligned holes, said posts having a series of transverse ratchets on facing surfaces of each splti post;

a second elongated paper clamping member aligned with said first paper clamping member on an opposite side of a stack of said sheets of paper than said first paper clamping means, said second paper clamping member including a first aperture and a hinged pawl member within said aperture and having at lease one pawl hingedly meshing within one of said series of transverse ratchets when said first and second paper clamping members are pushed together on a range of thicknesses of said stack of said sheets of paper, said series of split posts traversing through sid first aperture in said second paper clamping member; and in which said at least one pawl includes two pawls extending across said first aperture wherein, upon assembly of said clamping members, each of said pawls mesh with a facing one of said ratchets on said facing surfaces of one of said posts.

32. A paper stack binder for hole punched sheets of paper comprising:

a first elongated paper clamping member;

a series of split posts integrally extending from one side of said first clamping member for passing through aligned holes punched in said sheets of paper, said posts having a series of transverse ratchets on facing surfaces of each split post;

a second elongated paper clamping member aligned with said first paper clamping member on an opposite side of a stack of said sheets of paper than said first paper clamping means, said second paper clamping member including a first aperture and a hinged pawl member within said aperture and having at lease one pawl hingedly meshing within one of said series of transverse ratchets when said first and second paper clamping members are pushed together on a range of thicknesses of said stack of said sheets of paper, said series of split posts traversing through said first aperture in said second paper clamping member; and wherein said first aperture is essentially circular and said hinged pawl member bisects said first aperture to form a pair of channels essentially D-shaped in cross section and wherein said posts are essentially D-shaped in cross section, such that said posts slide through said channels and said aligned holes in said sheets of paper.

33. A paper stack binder for hole punched sheets of paper comprising:

a first elongated paper clamping member;

a series of split posts integrally extending from one side of said first clamping member for passing through aligned holes punched in said sheets of paper, said posts having a series of transverse ratchets on facing surfaces of each split post;

a second elongated paper clamping member aligned with said first paper clamping member on an opposite side of a stack of said sheets of paper than said first paper clamping means, said second paper clamping member including a first aperture and a hinged pawl member within said aperture and having at lease one pawl hingedly meshing within one of said series of transverse ratchets when said first and second paper clamping members are pushed together on a range of thicknesses of said stack of said sheets of paper, said series of split posts traversing through said first aperture in said second paper clamping member; and further comprising means for hingedly mounting said pawl member to said second clamping member and in which said means for hingedly mounting said pawl member comprises:

a pair of upstanding linear members integral with and extending from diametrically opposite positions on said second clamping member at a periphery of said first aperture;

an integral crossbar extending between said upstanding linear members; and hinge means integrally attached to said crossbar and said pawl member.

34. A paper stack binder for hole punched sheets of paper comprising:

a first elongated paper clamping member;

a series of split posts integrally extending from one side of said first clamping member for passing through aligned holes punched in said sheets of paper, said posts having a series of transverse ratchets on facing surfaces of each split post;

a second elongated paper clamping member aligned with said first paper clamping member on an opposite side of a stack of said sheets of paper than said first paper clamping means, said second paper clamping member including a first aperture and a hinged pawl member within said aperture and having at lease one pawl hingedly meshing within one of said series of transverse ratchets when said first and second paper clamping members are pushed together on a range of thicknesses of said stack of said sheets of paper, said series of split posts traversing through said first aperture in said second paper clamping member; and further comprising means on said second clamping member for receiving fingers of a tweezer tool to release said hinged pawl from meshing with said transverse ratchets.

35. A bound book comprising:

a plurality of sheets each formed with a plurality of spaced apertures adjacent one margin;

a first clamping member on one margin on one side of said book and covering at least two of said apertures;

a second clamping member on a margin on the other side of said book opposite of and aligned with said first clamping member said first and second clamping members being movable toward each other to accommodate a range of thickness of said book;

wherein said first clamping member includes a pair of posts extending integrally from said first clamping member through said at least two apertures of said plurality of sheets toward said second clamping means and each of said posts includes a linearly-extending, transversely ratcheted, surface facing a longitudinal central plane of said spaced apertures; and wherein said second clamping member includes integral pawl means hingedly mounted to said second clamping member for facing and meshing with successive transverse ratchets of said ratcheted surfaces to firmly clamp said plurality of sheets, said pawl means extending into ones of said plurality of spaced apertures of said plurality of sheets.

36. The book of claim 35 wherein said pawl means comprises a pair of linear-extending pawls, each of which mesh with a facing one of a pair of ratcheted facing surfaces on said posts.

37. The book of claim 35 in which said first and second clamping members are integrally formed on a pair of strips having a length substantially equal to the height of said sheets.

38. A bound book comprising:

a plurality of sheets each formed with a plurality of spaced apertures adjacent one margin;

a first clamping member on one margin on one side of said book and covering at least two of said apertures;

a second clamping member on a margin on the other side of said book opposite of and aligned with said first clamping member said first and second clamping members being movable toward each other to accommodate a range of thickness of said book;

wherein said first clamping member includes a pair of posts extending integrally from said first clamping member through said at least two apertures of said plurality of sheets toward said second clamping means and each of said posts includes a linearly-extending, transversely ratcheted, surface facing a longitudinal central plane of said spaced apertures;

wherein said second clamping member includes integral pawl means hingedly mounted to said second clamping member for facing and meshing with successive transverse ratchets of said ratcheted surfaces to firmly clamp said plurality of sheets; and wherein a multiplicity of discrete first and second clamping members are disposed in said apertures, said first and second clamping members each including a flat rectangular head, and further including a pair of elongated strips including a series of rectangular recesses for receiving said flat rectangular heads, said strips having a length approximate the height of said sheets.

39. A bound book comprising:

a plurality of sheets each formed with a plurality of spaced apertures adjacent one margin;

a first clamping member on one margin on one side of said book and covering at least two of said apertures;

a second clamping member on a margin on the other side of said book opposite of and aligned with said first clamping member said first and second clamping members being movable toward each other to accommodate a range of thickness of said book;

wherein said first clamping member includes a pair of posts extending integrally from said first clamping member through said at least two apertures of said plurality of sheets toward said second clamping means and each of said posts includes a linearly-extending, transversely ratcheted, surface facing a longitudinal central plane of said spaced apertures;

wherein said second clamping member includes integral pawl means hingedly mounted to said second clamping member for facing and meshing with successive transverse ratchets of said ratcheted surfaces to firmly clamp said plurality of sheets;

wherein a multiplicity of discrete first and second clamping members are disposed in said apertures, said first and second clamping members each including a flat rectangular head, and further including a pair of elongated strips including a series of rectangular recesses for receiving said flat rectangular heads, said strips having a length approximate the height of said sheets; and in which said posts extend from one of said elongated strips and wherein said posts extend through non-adjacent ones of said spaced apertures, said flat rectangular heads having edge reentrant recesses and said strips having parallel edge portions slidable within said reentrant recesses to interconnect and cover said clamping members.

40. A binder comprising:

a first clamping strip having a first series of spaced apertures extending therethrough;

a first clamping member having a head insertible into ones of said first series of apertures, said first clamping member further including a pair of spaced posts extending integrally from said head, each of said posts having a linearly-extending transversely ratcheted surface facing the other of said posts;

a second clamping strip having a second series of spaced apertures extending therethrough;

a second clamping member having a head insertible into ones of said second series of apertures, said strips being positionable to clamp a stack of apertured material therebetween;

a pawl member attached to said second clamping member and extending toward said first clamping member;

a first aperture extending through said second clamping member adjacent said pawl member; and means extending across said first aperture for hingedly mounting said pawl member and separating said first aperture into two channels such that, upon assembly of said first and second clamping members in ones of said first and second series of strip apertures, respectively, and through said stack of apertured material, said posts extend through said apertured material, respective ones of said spaced posts pass through respective ones of said channels, and said pawl member meshes with successive transverse ratchets of at least one of said ratcheted surfaces to firmly clamp said stack of apertured material together.

41. The binder of claim 40 wherein said pawl member comprises a pair of hinged pawls, each of which mesh with a facing one of the ratcheted surfaces on said pair of spaced posts.

42. The binder of claim 40 in which the heads of the first and second clamping members are rectangular and said first and second series of strip apertures are rectangular recesses configured to receive said first and second clamping members.

43. The binder of claim 40 in which the heads of said first and second clamping members and said first and second series of strip apertures are configured such that said heads snap into and are held into respective ones of said first and second series of strip apertures.

44. The binder of claim 43 including snap ridges on peripheral edges of said heads of said first and second clamping members and cooperating ridges on peripheral edges of said strip apertures.

45. A binder for a stack of apertured paper comprising:

a first clamping member including at least one post extendible fully through an edge aperture in said stack, said post having a transversely ratcheted surface facing interiorly of said stack edge aperture and a smooth outer surface slidable on interior edges of said stack edge aperture; and a second clamping member including a hinged pawl extendible partially into said stack edge aperture and having at least one pawl member facing said post ratcheted surface which, upon assembly of said clamping members in said stack edge aperture, said pawl member meshes with successive transverse ratchets of said ratcheted post surface to firmly clamp said stack of apertured paper together.

46. The binder of claim 45 further including:

a first clamping strip positionable over a margin of said apertured sheets and a series of said posts integrally extending from said first clamping strip; and a second clamping strip positionable over an opposed margin of said apertured sheets and a series of hinged pawls integrally extending from said second clamping strip, such that said strips and said first and second clamping members clamp a margin of said stack of apertured paper.

47. The binder of claim 45 wherein said first clamping member includes a single post and said second clamping member includes a single pawl member.

48. The binder of claim 45 wherein said first clamping member includes a pair of said posts and said second clamping member includes a pair of said pawl members.

49. The binder of claim 45 in which said first clamping member includes two posts and said hinged pawl comprises a single pawl member which meshes with a single one of said ratcheted surfaces of a single one of said posts.

50. The binder of claim 49 in which only one of said posts of said first clamping member has a ratcheted surface.

* * * * *

UNITED STATES PATENT AND TRADEMARK OFFICE

CERTIFICATE OF CORRECTION

PATENT NO. : 4,730,972

DATED : March 15, 1988

INVENTOR(S) : Rickson Sun; David M. Kelley; Craig F. Sampson; Cynthia L. Benjamin; Dennis J. Boyle It is certified that error appears in the above-identified patent and that said Letters Patent is hereby corrected as shown below:

In the Abstract, line 19, change "spacers" to --spaced--.

In the Drawing, Sheet 1, Fig. 1, add the reference numeral --10-- and a horizontal arrowed lead line in the area between reference numerals "8" and "20" pointing to the overall two-part connector.

In the Drawing, Sheet 2, Fig. 4A, change numeral "38" to --7--.

Column 3, line 58, delete "and".

Column 3, line 61, delete "a".

Column 5, line 1, change "14" to --11--.

Column 5, line 7, delete "then the" and insert therefor --adjacent--.

Column 5, line 43, after "ridge" insert --34--.

Column 5, line 45, after "root" insert --36--.

Column 6, line 29, delete "and 79".

Column 6, line 53, delete "90".

UNITED STATES PATENT AND TRADEMARK OFFICE

CERTIFICATE OF CORRECTION

PATENT NO. : 4,730,972

DATED : March 15, 1988

INVENTOR(S) : Rickson Sun; David M. Kelley; Craig F. Sampson; Cynthia L. Benjamin; Dennis J. Boyle It is certified that error appears in the above-identified patent and that said Letters Patent is hereby corrected as shown below:

Column 7, line 57, change "keeps" to --keep--.

Column 13, line 34, change "splti" to --split--.

Column 13, line 46, change "sid" to --said--.

In the Drawing, Sheet 1, Fig. 1, delete reference numeral "13".

Signed and Sealed this

Twenty-third Day of May, 1989

*Attest:*

DONALD J. QUIGG

*Attesting Officer*

*Commissioner of Patents and Trademarks*